US007012182B2

(12) United States Patent
Nishitani et al.

(10) Patent No.: US 7,012,182 B2
(45) Date of Patent: Mar. 14, 2006

(54) MUSIC APPARATUS WITH MOTION PICTURE RESPONSIVE TO BODY ACTION

(75) Inventors: Yoshiki Nishitani, Hamakita (JP); Eiko Kobayashi, Hamakita (JP)

(73) Assignee: Yamaha Corporation, Shizuoka (JP)

( * ) Notice: Subject to any disclaimer, the term of this patent is extended or adjusted under 35 U.S.C. 154(b) by 411 days.

(21) Appl. No.: 10/460,966

(22) Filed: Jun. 13, 2003

(65) Prior Publication Data

US 2004/0000225 A1 Jan. 1, 2004

(30) Foreign Application Priority Data

Jun. 28, 2002 (JP) ..... 2002-191105

(51) Int. Cl.
*G10H 7/00* (2006.01)
*G10H 13/00* (2006.01)

(52) U.S. Cl. ..... 84/609; 84/610; 84/634; 84/649; 84/650; 84/666; 84/477 R; 84/723

(58) Field of Classification Search ..... None
See application file for complete search history.

(56) References Cited

U.S. PATENT DOCUMENTS 5,081,896 A * 1/1992 Hiyoshi et al. ..... 84/600
5,159,140 A * 10/1992 Kimpara et al. ..... 84/600
5,177,311 A 1/1993 Suzuki et al.
5,290,964 A * 3/1994 Hiyoshi et al. ..... 84/600
5,648,627 A * 7/1997 Usa ..... 84/600
5,908,996 A * 6/1999 Litterst et al. ..... 84/600
6,297,438 B1 * 10/2001 Por Paul ..... 84/600
2001/0015123 A1 8/2001 Nishitani et al.
2002/0088335 A1 * 7/2002 Nishitani et al. ..... 84/600
2002/0166439 A1 * 11/2002 Nishitani et al. ..... 84/600
2002/0170413 A1 * 11/2002 Nishitani et al. ..... 84/600
2003/0066413 A1 * 4/2003 Nishitani et al. ..... 84/615
2003/0070537 A1 4/2003 Nishitani et al.
2003/0167908 A1 * 9/2003 Nishitani et al. ..... 84/723
2003/0230186 A1 * 12/2003 Ishida et al. ..... 84/737

FOREIGN PATENT DOCUMENTS

GB 2377315 A 1/2003

* cited by examiner

*Primary Examiner*—Marlon Fletcher
(74) *Attorney, Agent, or Firm*—Harness, Dickey & Pierce, P.L.C.

(57) ABSTRACT

A performance processing apparatus is operable by an operation device and equipped with a sound device and a display device. In the apparatus, a storing section stores song data representative of a music sound constituting a music song, and stores image data representative of an image. An acquiring section acquires detection information from the operation device, which is used by a user and which has a detector for detecting a chronological action or state of the user and outputting the detection information representative of the detected chronological action or state. A sound control section generates the music sound through the sound device according to the song data, and controls a progression degree of the generation of the music sound according to the acquired detection information. A display control section displays the image by the display device according to the image data in correspondence with the progression degree of the generating of the music sound. The display control section further controls a rendering mode of the image in accordance with the detection information.

21 Claims, 11 Drawing Sheets

FIG.5

| HEADER CHUNK | SONG DATA CHUNK | PART SPECIFICATION CHUNK | IMAGE DATA CHUNK |
|---|---|---|---|

FIG.6

| | |
|---|---|
| IDa | PART #1 |
| IDb | PART #2 |
| IDc | PART #3, #4 |
| ⋮ | ⋮ |

FIG.7

| | | | | | | |
|---|---|---|---|---|---|---|
| PART DATA [PART #1] | Δt | EVENT | Δt | EVENT | ... | EVENT |
| PART DATA [PART #2] | Δt | EVENT | Δt | EVENT | ... | EVENT |
| PART DATA [PART #3] | Δt | EVENT | Δt | EVENT | ... | EVENT |

FIG.8

| | | | | | | |
|---|---|---|---|---|---|---|
| IMAGE DATA SEQUENCE [IDa] | BEAT COUNT Na1 | IMAGE DATA a1 | BEAT COUNT Na2 | IMAGE DATA a2 | ... | IMAGE DATA ak |
| IMAGE DATA SEQUENCE [IDb] | BEAT COUNT Nb1 | IMAGE DATA b1 | BEAT COUNT Nb2 | IMAGE DATA b2 | ... | IMAGE DATA bk |
| IMAGE DATA SEQUENCE [IDc] | BEAT COUNT Nc1 | IMAGE DATA c1 | BEAT COUNT Nc2 | IMAGE DATA c2 | ... | IMAGE DATA ck |

FIG.12

| | | |
|---|---|---|
| IMAGE DATA 1 | ACTION | INTERVAL BETWEEN SPEED MINIMUM POINTS : t1~t2<br>SPEED : v1~v2 |
| IMAGE DATA 2 | ACTION | INTERVAL BETWEEN SPEED MINIMUM POINTS : t1~t2<br>SPEED : v2~v3 |
| ⋮ | ⋮ | |
| IMAGE DATA 5 | ACTION | INTERVAL BETWEEN SPEED MINIMUM POINTS : t2~t3<br>SPEED : v1~v2 |
| IMAGE DATA 6 | ACTION | INTERVAL BETWEEN SPEED MINIMUM POINTS : t2~t3<br>SPEED : v2~v3 |
| ⋮ | ⋮ | |

MUSIC APPARATUS WITH MOTION PICTURE RESPONSIVE TO BODY ACTION

BACKGROUND OF THE INVENTION

1. Technical Field of the Invention

The present invention relates to a technology of controlling a music sound generated from a sound device such as a speaker in accordance with user's actions or physical states. More specifically, the present invention relates to a performance processing apparatus to display images on a display device along with the music sound output, a performance processing program to allow a computer to function as the performance processing apparatus, and a file creating apparatus to generate a file to be used for the sound output and the image display through the performance processing apparatus.

2. Prior Art

Conventionally, there is provided an apparatus that uses a display device to display musical scores or lyrics while a user plays a musical instrument or sings. Using this apparatus, the user can exercise a musical performance by making performance actions so as to follow the displayed images.

However, this type of apparatus predetermines timings of displaying images on the display device and contents of the images regardless of user's performance actions. For this reason, the apparatus makes it difficult to synchronize performance actions with display images, and therefore causes to lose a pleasure in the performance for users who cannot make performance actions smoothly for some reason such as beginners not accustomed to performance actions or physically handicapped persons.

SUMMARY OF THE INVENTION

The present invention has been made in consideration of the foregoing. It is therefore an object of the present invention to provide a performance processing apparatus to enable a user to easily enjoy performance in a configuration of displaying images during user's performance actions, a performance processing program to allow a computer to function as the performance processing apparatus, and a file creating apparatus to create files to be used for performance processing in the performance processing apparatus.

In order to solve the above-mentioned problems, according to a first aspect of the present invention, there is provided a performance processing apparatus operable by an operation device and equipped with a sound device and a display device. The performance processing apparatus comprises a storing section that stores song data representative of a music sound constituting a music song, and stores image data representative of an image, an acquiring section that acquires detection information from the operation device, which is used by a user and which has a detector for detecting a chronological action or state of the user and outputting the detection information representative of the detected chronological action or state, a sound control section that generates the music sound through the sound device according to the song data, and that controls a progression degree of the generation of the music sound according to the acquired detection information, and a display control section that displays the image by the display device according to the image data in correspondence with the progression degree of the generating of the music sound.

This configuration controls a progression degree of sound output (e.g., tempo) in accordance with user's actions or physical states and displays an image on the display device in accordance with a sound output progression. That is to say, the image is displayed at the timing corresponding to a user's action or physical state so as to follow the user's action or physical state. Accordingly, the user can easily enjoy performance actions compared to the conventional configuration that displays images at permanently predetermined timings. Here, the "progression degree" signifies a degree indicating how output of a sound constituting the music song progresses. Therefore, "controlling the progression degree" means adjusting a chronological degree of sound output (song performance) progression according to the detection information, for example, adjusting a tempo (progression speed) or a time length equivalent to one beat of the song.

In this configuration, the sound control section may adjust the progression degree of sound output specified by the tempo information or the beat information based on the detection information. Here, the tempo information specifies a sound output tempo (song performance speed) with numeric values. The beat information specifies a song beat. Specifically, the beat information can be used as information for specifying a time length equivalent to one beat, information for specifying a temporal balance between two chronologically adjacent beats, or information for specifying a song rhythm.

When the song data contains a plurality of part data each indicating a sound of a different part, the following embodiment is preferable. The acquiring section obtains the detection information from a plurality of operation devices each corresponding to one or more parts. The sound control section controls the progression degree of sound output associated with one or more parts corresponding to each operation device based on the detection information obtained from the relevant operation device. The display control section uses a display device to display an image indicated by the image data for one or more parts corresponding to each operation device in accordance with the sound output progression of the relevant part. Since one or more parts are allocated to each of a plurality of operation devices in this preferred embodiment, a plurality of users can joitly enjoy performances. Images prepared for each user are displayed at the timing corresponding to each user's action or physical state. Accordingly, there is provided a new amusement of comparing an image displayed at the timing corresponding to the user's action or physical state with an image displayed at the timing corresponding to another user's action or physical state.

When images are displayed for each user, the display device may need to display a plurality of images depending on sound output progressions in each part. In such case, it may be preferable to display the images in a plurality of areas or sub frames that are created by partitioning a screen frame of the display device. Alternatively, it may be preferable to use a plurality of display devices to display the corresponding images. Further, it may be preferable that the display control section controls rendering modes of images displayed on the display device in accordance with a progression of sound output from the sound device.

In order to solve the above-mentioned problems, according to a second aspect of the present invention, there is provided another performance processing apparatus operable by an operation device and equipped with a sound device and a display device. The performance processing apparatus comprises a storing section that stores song data representative of a music sound constituting a music song, and stores image data representative of an image, an acquiring section that acquires detection information from the operation device, which is used by a user and which has a detector for detecting a chronological action or state of the user and outputting the detection information representative of the detected chronological action or state, a sound control section that generates the music sound through the sound device according to the song data and controls the generating of the music sound according to the acquired detection information, and a display control section that displays the image by the display device according to the image data and controls a rendering mode of the image displayed on the display device according to the acquired detection information.

This configuration controls rendering modes of image display in accordance with user's actions or physical states. Accordingly, the user can easily enjoy performance actions compared to the old configuration that displays images in permanently predetermined rendering modes. In addition, there are provided interesting and versatile display images reflecting users' actions.

When the song data contains a plurality of part data each indicating a sound of a different part, the following embodiment is preferable. The acquiring section obtains the detection information from a plurality of operation devices each corresponding to one or more parts. The sound control section controls a sound of one or more parts corresponding to each operation device based on the detection information obtained from the relevant operation device. The display control section displays an image indicated by the image data for one or more parts corresponding to each operation device in a rendering mode associated with the detection information obtained from the relevant part. Since one or more parts are allocated to each of a plurality of operation devices in this preferred embodiment, a plurality of users can enjoy performances. In addition, there is provided a new amusement of comparing an image displayed in the rendering mode corresponding to the user's action or physical state with another image displayed in the rendering mode corresponding to another user's action or physical state.

When the performance processing apparatus according to the present invention employs the configuration in which the display control section controls rendering modes of display images on the display device, available image rendering modes to be controlled may include the image brightness, coloring, resolution, size, and the like. Obviously, it may be preferable to change display image contents themselves in accordance with the detection information.

BRIEF DESCRIPTION OF THE DRAWINGS

FIG. 5 shows a configuration of a performance file used for the performance processing apparatus.

FIG. 6 shows a configuration of a part specification chunk contained in the performance file.

FIG. 7 shows a configuration of a song data chunk contained in the performance file.

FIG. 8 shows a configuration of a image data chunk contained in the performance file.

FIG. 12 shows a configuration of an image data chunk according to the second embodiment of the present invention.

DETAILED DESCRIPTION OF THE INVENTION

Several preferred embodiments of the present invention will be described below with reference to the accompanying drawings. The following embodiments present a mode of the present invention and do not limit the present invention. Furthermore, the present invention may be embodied in various modifications without departing from the spirit and scope of the invention.

<A: First Embodiment>

Figure 1:
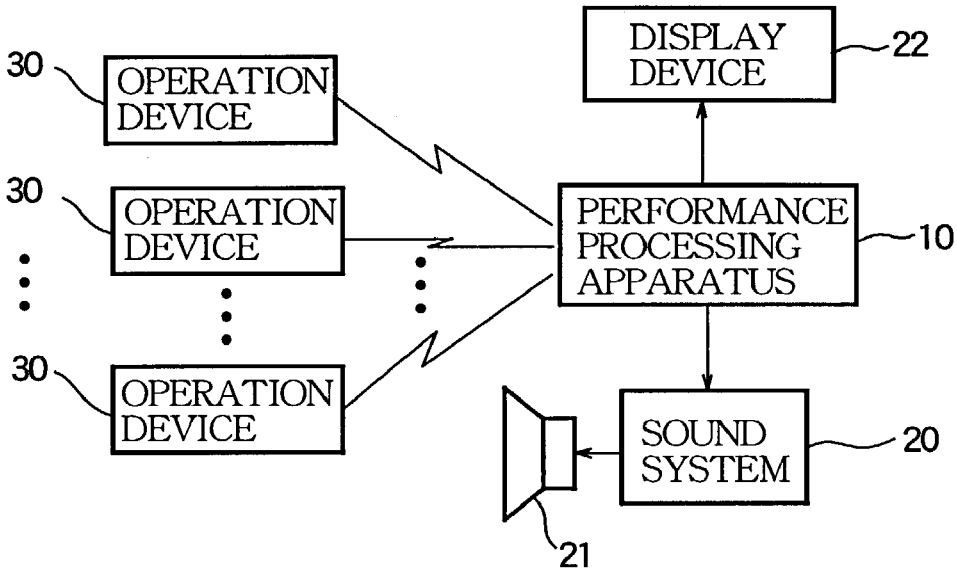
FIG. 1 is a block diagram showing a configuration of the performance system according to the first embodiment of the present invention.

With reference to FIG. 1, the following describes an overall configuration of a performance system according to the first embodiment of the present invention. As shown in FIG. 1, the performance system comprises a performance processing apparatus 10, a sound system 20, a speaker 21, a display device 22, and a plurality of operation devices 30. The sound system 20 and the display device 22 are connected to the performance processing apparatus 10.

The display device 22 comprises a CRT (Cathode Ray Tube) or a liquid crystal display panel and displays various images under control of the performance processing apparatus 10. The sound system 20 and the speaker 21 are apparatuses that output musical sounds under control of the performance processing apparatus 10. That is to say, the sound system 20 comprises a D/A converter and an amplifier. The D/A converter receives digital data representing a musical sound waveform (hereafter referred to as "musical sound waveform data") from the performance processing apparatus 10 and converts that data into an analog signal. The amplifier amplifies the analog signal output from the D/A converter. The speaker 21 outputs the analog signal from the sound system 20 as an audible sound. It may be preferable to use earphones or headphones attachable to ears instead of the speaker 21.

Figure 2:
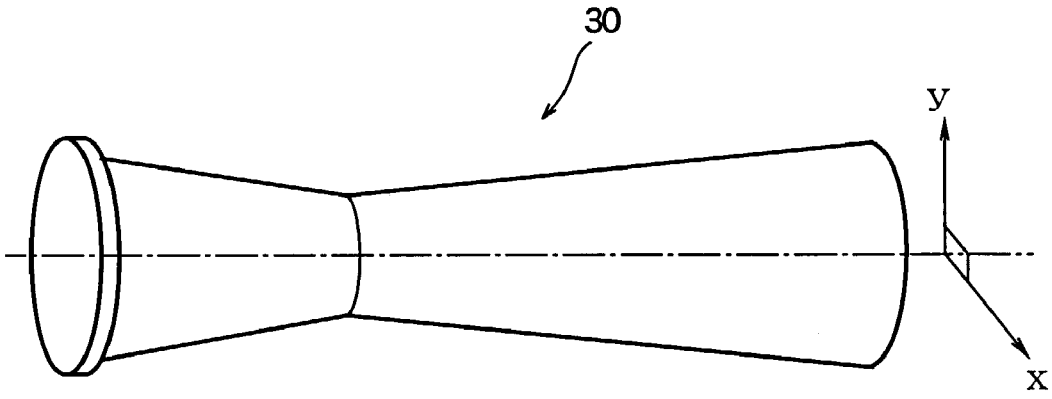
FIG. 2 is a perspective view showing an external view of an operation device.

Each of a plurality of operation devices 30 is held by a user is worn on the user's body, detects the user's operation, and sends information representing the detection result (hereafter referred to as "detection information") to the performance processing apparatus 10. As shown in FIG. 2, the operation device 30 according to the embodiment is a long, approximately cylindrical member that can be held by the user. More specifically, the operation device 30 is tapered from the both ends toward approximately the center of the longer direction so that a diameter near that approximate center is smaller than diameters at both ends. The user holds the approximate center of the operation device 30 and freely shakes or waves the operation device 30.

Figure 3:
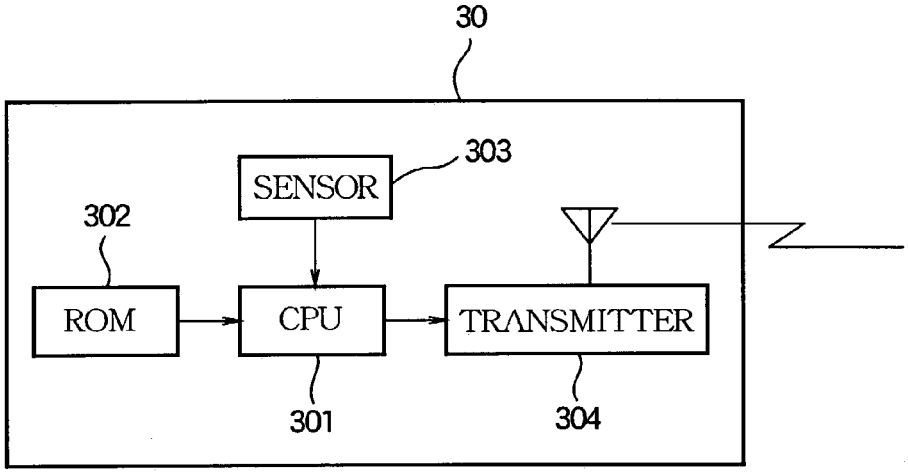
FIG. 3 is a block diagram showing a configuration of the operation device constituting the performance system.

FIG. 3 is a block diagram showing an internal configuration of one operation device 30. As shown in FIG. 3, the operation device 30 comprises a CPU (Central Processing Unit) 301, ROM (Read Only Memory) 302, a sensor 303, and a transmitter 304. The CPU 301 executes a program stored in the ROM 302 to control an overall operation of the operation device 30. The ROM 302 stores not only the program executed by the CPU 301, but also identification information uniquely allocated to the operation device 30.

The sensor 303 outputs an electric signal corresponding to the user's action, i.e., an electric signal corresponding to movements of the operation device 30 in accordance with the user's action, to the CPU 301. In the embodiment, it is assumed that a two-dimensional speed sensor is used for the sensor 303. As shown in FIG. 2, let us suppose that there are two axes X and Y orthogonal to each other on a surface orthogonal to the longer direction of the operation device 30. The sensor 303 according to the embodiment outputs electric signals corresponding to the X-axis and Y-axis direction components of a movement speed of the operation device 30. Based on the electric signal supplied from the sensor 303, the CPU 301 generates detection information representing speeds along the X-axis and Y-axis directions.

The transmitter 304 in FIG. 3 enables communication with the performance processing apparatus 10. More specifically, the transmitter 304 transmits the detection information generated from the CPU 301 together with the identification information of the operation device 30. Systems for communication between the transmitter 304 and the performance processing apparatus 10 include not only wireless communication compliant with the infrared data communication and BlueTooth (registered trademark), but also wire communication via a communication line connecting the transmitter 304 with the performance processing apparatus 10.

The performance processing apparatus 10 generates sounds constituting a song from the speaker 21 and controls a progression degree of the song based on the detection information received from each operation device 30. Further, the performance processing apparatus 10 uses the display device 22 to display an image at the timing corresponding to the song progression. Here, the "progression degree" of the song means a degree (extent) of the progression of the song performance (sound output from the speaker 21). "Adjusting the progression degree based on the detection information"refers to the concept including all processes that vary the song progression in accordance with the detection information such as, for example, adjusting a song tempo (progression speed) or a time length per beat in accordance with the detection information. In the present embodiment, however, it is assumed to control song tempos in accordance with the detection information.

Figure 4:
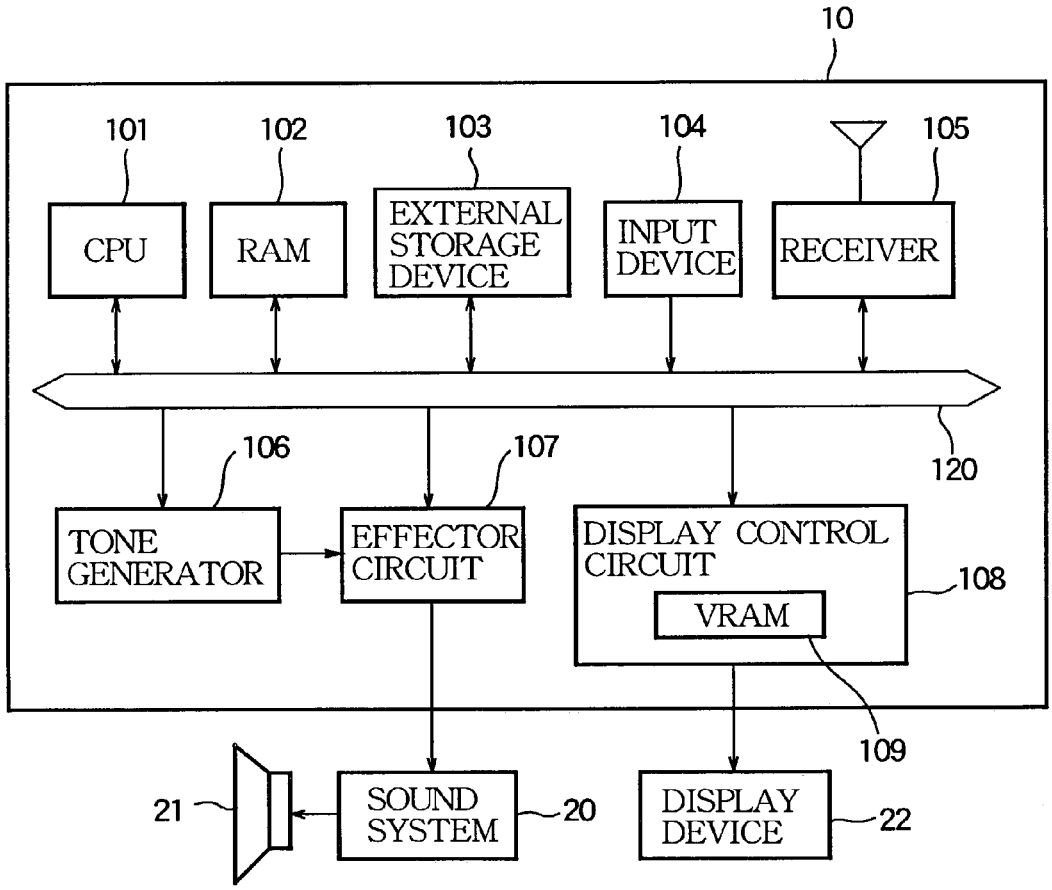
FIG. 4 is a block diagram showing a configuration of a performance processing apparatus constituting the performance system.

As shown in FIG. 4, the performance processing apparatus 10 comprises a CPU (Central Processing Unit) 101, RAM (Random Access Memory) 102, an external storage device 103, an input device 104, a receiver 105, a tone generator 106, an effector circuit 107, and a display control circuit 108. These components are connected to each other via a bus 120.

The CPU 101 controls the external storage device 103 and executes a program stored in the ROM (Read Only Memory), not shown, to control each component of the performance processing apparatus 10. The CPU 101 uses the RAM 102 is used as a main storage. The RAM 102 temporarily stores programs executed by the CPU 101 or data used for program execution.

The external storage device 103 represents, for example, a hard disk drive, a flexible disk drive, a magnet optical disk drive, or a DVD (Digital Versatile Disk) drive, and stores a program executed by the CPU 101. The program represents a performance processing program that controls the song performance and the image display in accordance with the detection information transmitted from the operation device 30.

The external storage device 103 stores a plurality of performance files each corresponding to one song. FIG. 5 shows a configuration of the performance file corresponding to one song. As shown in FIG. 5, the performance file includes a header chunk, a song data chunk, a part specification chunk, and an image data chunk. The header chunk includes various types of information about the song or the performance file, e.g., data representing the data format or the data length of the performance file, data representing a time interval equivalent to a quarter note (hereafter referred to as a "unit time"), and the like.

A song to be played in this embodiment is assumed to comprise a plurality of parts with different timbres and pitches. Each operation device 30 is allocated with one or more parts out of a plurality of parts constituting a song. Musical sounds are included in one or more parts allocated to the operation device and are appropriately changed correspondingly to the detection information transmitted from each operation device 30. The part specification chunk in the performance file is data that specifies the contents of the allocation. As shown in FIG. 6, the part specification chunk represents a table that maintains correspondence between the identification information of each operation device 30 and one or more part numbers included in a song. In FIG. 6, for example, "part #1" is allocated to the operation device 30 with identification information "IDa". Two parts "part #3" and "part #4" are allocated to the operation device 30 with identification information "IDc".

The song data chunk is a set of data that specifies musical sounds constituting a song. One song data chunk contains a plurality of data corresponding to different parts (hereafter referred to as "part data"). As shown in FIG. 7, each part data is a data sequence that sequentially arranges many sets each comprising a delta time (Δ) and an event. Each event contains a note number representing a pitch, a note-on event for generating a musical sound or a note-off event for muting a musical sound, and a velocity representing the sound generation intensity. On the other hand, the delta time is data representing a time interval for outputting two chronologically consecutive events to the tone generator 106. That is to say, the CPU 101 outputs an event to the tone generator 106, and then outputs the next event to the tone generator 106 after elapse of a time length equivalent to the delta time. A clock generator (not shown) generates a timing clock to count the delta time on the basis of one or more parts allocated to one operation device 30. Accordingly, it is possible to vary the tempo for one or more parts associated with one operation device 30 by independently varying the cycle of each timing clock.

As shown in FIG. 8, the image data chunk contains a plurality of image data sequences for each of the operation devices 30. Each image data sequence is a data sequence that sequentially arranges many sets each comprising a preset beat count and image data. When a set of the preset beat count and image data indicates an image, the preset beat count indicates a timing of the image to be displayed on the display device 22. According to the embodiment, a period for performing a song includes the timing to display an image based on each image data. This timing is specified as an index determined by counting beats from the beginning of the song based on the unit time as one beat contained in the header chunk. In FIG. 8, for example, image a1 is prepared for the operation device 30 with identification information "IDa" and is displayed on the display device 22 at the timing when the beat count reaches Na1 from the beginning of the song performance.

The input device 104 in FIG. 4 has a plurality of buttons operated by a user and outputs a signal corresponding to the user's operation to the CPU 101. The receiver 105 is used for communication with each operation device 30. That is to say, the receiver 105 receives the detection information transmitted from each operation device 30 and outputs the detection information to the CPU 101.

When supplied with an event from the CPU 101, the tone generator 106 generates musical sound waveform data that represents a musical sound waveform corresponding to the event. The tone generator 106 has a plurality of channels corresponding to different parts. Each channel is supplied with an event of part data corresponding to the channel. In this configuration, the tone generator 106 outputs musical sound waveform data for each part in parallel.

The effector circuit 107 provides various effects to the musical sound waveform data output from the tone generator 106. The CPU 101 determines the content and the degree of an effect provided by the effector circuit 107 to the musical sound waveform data for each part based on the detection information received from the operation device 30 corresponding to each part. The effector circuit 107 can provide a variety of effects including reverberation effects such as reverb and echo. The embodiment assumes that the reverb is provided. In this case, the reverb time (reverberation depth) varies with the content of the detection information.

The display control circuit 108 displays an image on the display device 22 in accordance with an instruction from the CPU 101. The display control circuit 108 has VRAM (Video Random Access Memory) 109 that stores one screen of image data to be displayed on the display device 22. When the CPU 101 supplies image data at the timing corresponding to the preset beat count in the image data chunk, the display control circuit 108 writes this image data to the VRAM 109. This image data is read one line at a time in synchronization with a specified scanning cycle and is supplied to the display device 22.

The following describes operations of the performance system according to the embodiment.

Figure 9:
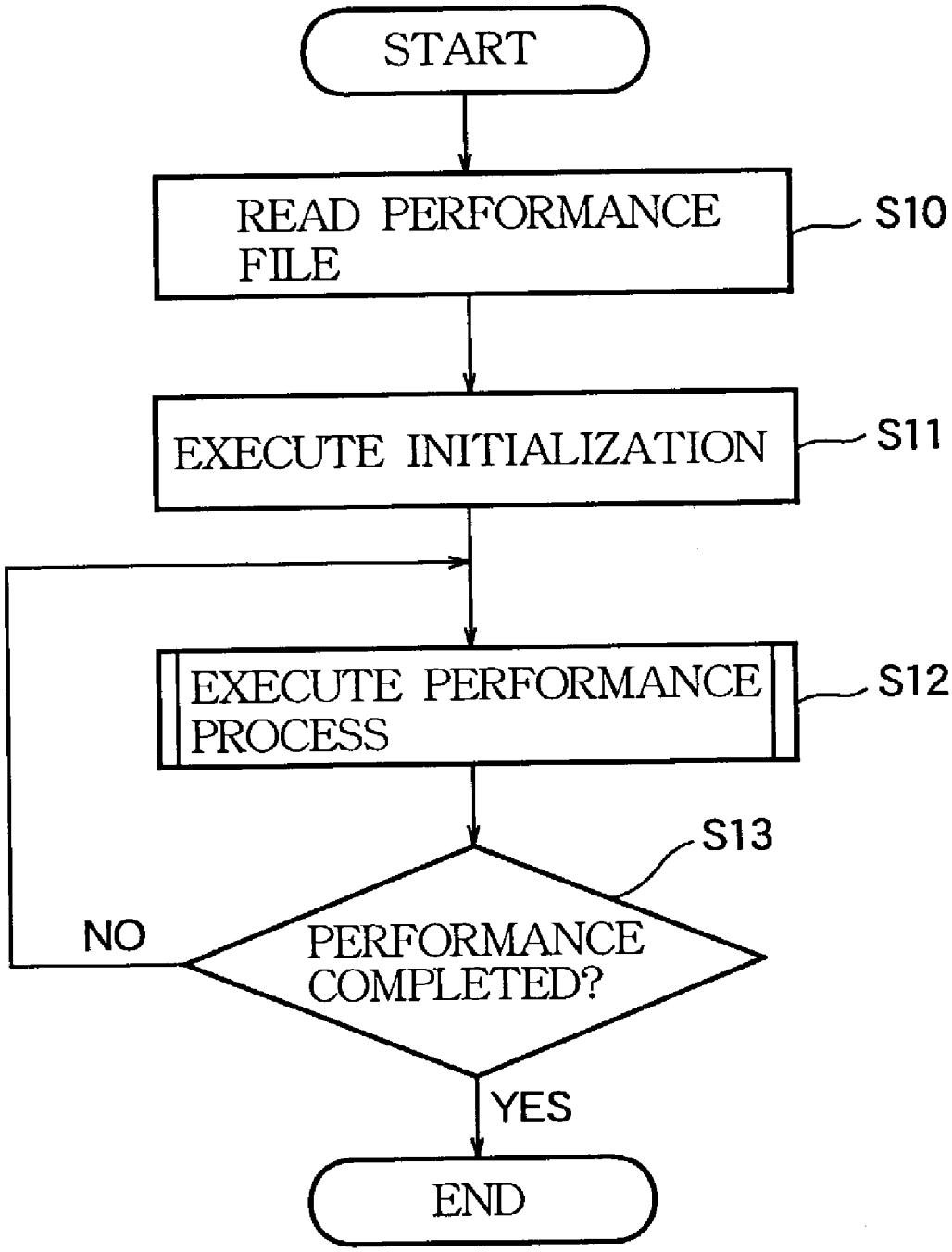
FIG. 9 is a flowchart showing contents of a main routine executed by the performance processing apparatus.

When a user operates the input device 104 as specified, the CPU 101 reads the performance processing program stored in the external storage device 103 into the RAM 102 and sequentially executes that program. FIG. 9 is a flowchart showing a main routine of the performance processing program.

When the user operates the input device 104 of the performance processing apparatus 10 to select a song to be performed, the CPU 101 reads a performance file corresponding to the selected song into the RAM 102 (step S10). The CPU 101 then executes the initialization concerning the performance (step S11). During this initialization, for example, the unit time included in the header chunk is defined as the time length equivalent to a quarter note.

When the user operates the input device 104 as specified to start the performance, the CPU 101 executes a performance process for the song (step S12). The performance process is repeated until the performance becomes complete for the entire song (No at step S13).

Each user turns on his or her operation device 30 and freely waves or shakes the operation device 30 in accordance with the performance process by means of the performance processing apparatus 10. The CPU 301 of each operation device 30 allows the transmitter 304 to transmit the detection information corresponding to an output signal from the sensor 303 and the identification information stored in the ROM 302.

Figure 10:
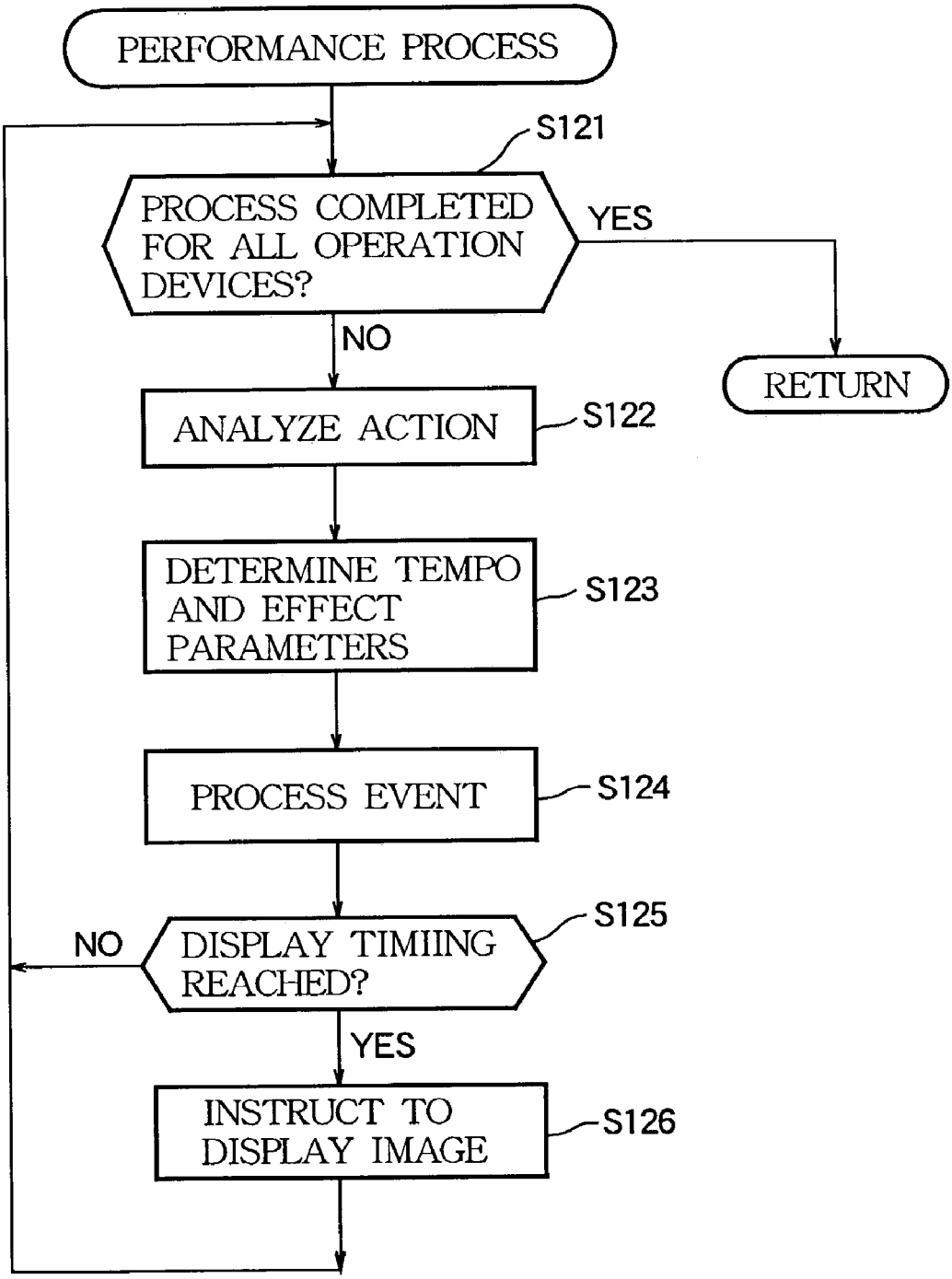
FIG. 10 is a flowchart showing contents of a performance process carried out by the performance processing apparatus.

Referring now to FIG. 10, the following describes specific contents of the above-mentioned performance process (step S12). As shown in FIG. 10, the CPU 101 executes the process from steps S122 to S126 for each of the operation devices 30. If the process is complete for all the operation devices (Yes at step S121), control returns to step S13 in FIG. 9. Depending on cases, the following description uses the term "target operation device 30" out of a plurality of the operation devices 30 to express the operation device 30 targeted for the process from steps S122 to S126.

At step S122, the CPU 101 analyzes the action of the user who owns the operation device 30 based on the detection. information received from the target operation device 30 via the receiver 105. More specifically, based on the detection information received from the target operation device 30, the CPU 101 recognizes a speed minimum, namely, a time point that reverses a Y-axis direction component of a speed of the target operation device 30, and detects a time interval between two chronologically consecutive speed minimums. Further, the CPU 101 computes a movement speed of the target operation device 30 using X-axis and Y-axis direction components of the movement speed contained in the detection information.

Based on the analysis result at step S122, the CPU 101 then determines tempo and effect parameters for one or more parts allocated to the operation device 30 (step S123). The specific process is described below. The CPU 101 first increases or decreases the tempo in accordance with the time interval between speed minimums for the target operation device 30. For example, the tempo increases when there is a small time interval between speed minimums, i.e., the target operation device is trembled quickly. On the contrary, the tempo decreases when there is a large time interval between speed minimums, i.e., the target operation device is waved with a large amplitude. Decreasing or increasing the tempo is adjusted by varying a cycle of the timing clock used for counting the delta time. The CPU 101 increases or decreases the reverb time in response to the movement speed of the operation device 30. When the movement speed is high, i.e., when the operation device 30 is shaken quickly, the CPU 101 supplies a short reverb time to the effector circuit 107. When the movement speed is low, i.e., when the operation device 30 is shaken slowly, the CPU 101 supplies a long reverb time to the effector circuit 107.

The CPU 101 then processes the event for the part data allocated to the target operation device 30 (step S124). That is to say, the CPU 101 determines elapse of the delta time based on the number of timing clocks corresponding to the target operation device 30, and then outputs an event immediately after that delta time to the tone generator 106. If the CPU 101 determines that the delta time has not yet elapsed, the CPU 101 outputs no events.

When an event for any part is input to a channel corresponding to the part, the tone generator 106 outputs musical sound waveform data corresponding to this event. The effector circuit 107 provides the musical sound waveform data output from the tone generator 106 with a reverb corresponding to the instruction from the CPU 101 at step S123 and outputs the musical sound waveform data. As a result, this outputs a musical sound supplied with the reverb corresponding to an action of the user of the operation device 30 at the tempo corresponding to the user's action for one or more parts allocated to that operation device 30.

The CPU 101 counts the number of beats from the beginning of the song performance to the current point (hereafter referred to as the "current beat count") on the basis of the timing clock and the number of clocks equivalent to the unit time length for one or plurality of parts allocated to one operation device 30. At step S125, the CPU 101 determines whether or not the timing is reached to display the image in the image data sequence depending on whether or not the current beat count matches any preset beat count contained in the image data sequence for the target operation device 30 in the image data chunk. That is to say, the CPU 101 determines that the image display timing is reached when the preset beat count matches the current beat count. In this case, the CPU 101 reads image data corresponding to the preset beat count from the RAM 102, outputs the image data to the display control circuit 108 (step S126), and then returns control to step S121. If the preset beat count differs from the current beat count, this means that the image display timing is not reached. The CPU 101 returns control to step S121 without proceeding to step S126. Thereafter, the CPU 101 repeats steps S122 to S126 for the other operation devices 30. When the process is complete for all the operation devices 30, the CPU 101 passes control to step S13 in FIG. 9.

The display control circuit 108 stores the image data supplied from the CPU 101 at step S126 in the VRAM 109. As a result, the image associated with each operation device 30 is displayed on the display device 22 at the timing corresponding to the preset beat count. Here, the time length for one beat varies with an action of the user of the operation device 30 for one or more parts allocated to that operation device 30. Accordingly, an image prepared for the specific operation device 30 is displayed at the timing corresponding to progression of one or more parts allocated to that operation device 30.

If the current beat count exceeds an index specified for a plurality of operation devices 30, it is necessary to display a plurality of images corresponding to these operation devices 30 on the display device 22. In this case, a display area of the display device 22 is partitioned into as many portions as the number of images to be displayed. The display control circuit 108 stores image data for these images in the VRAM 109 so that the images can be displayed in the corresponding partitions of the display area. The following describes an example of the partitioned display with reference to FIG. 11. In the description below, it is assumed that "part #1" is allocated to the operation device 30 with identification information "IDa"; "part #2" is allocated to the operation device 30 with identification information "IDb"; and "parts #3 and #4" are allocated to the operation device 30 with identification information "IDc". It is also assumed that the operation device 30 with identification information "IDa" has the first preset beat count Na1 set to "3" and the second preset beat count Na2 set to "15" as corresponding preset indexes. Further, it is assumed that the operation devices 30 with identification information "IDb" and "IDc" have their first preset beat counts Nb1 and Nc1 set to "8" and "12", respectively.

Figure 11:
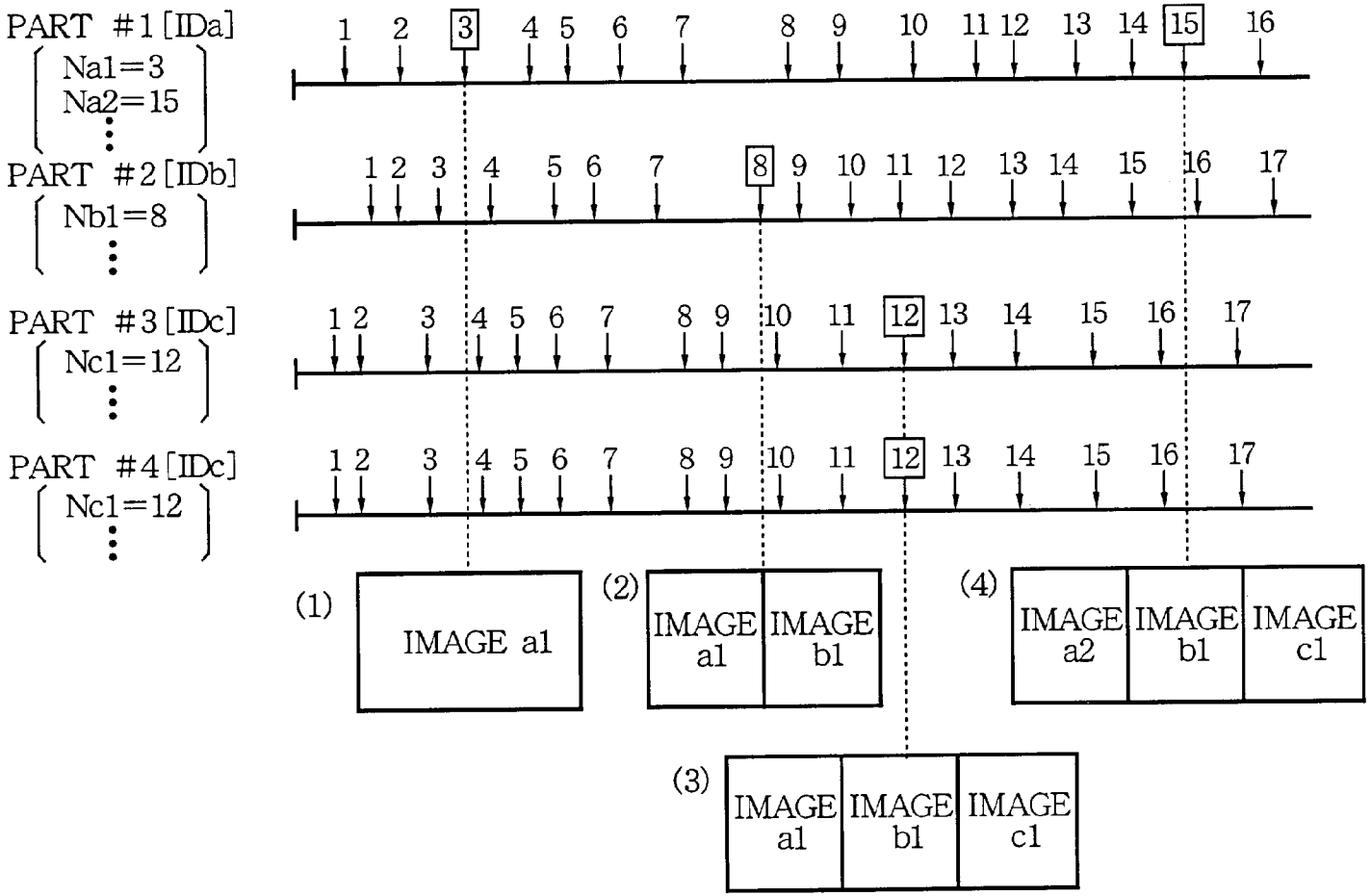
FIG. 11 is a timing chart for explaining an operation example of the performance processing apparatus.

At the timing when the current beat count for "part #1" reaches the third beat (=Na1), image a1 is displayed on the entire area of the display device 22 (see (1) in FIG. 11). When the current beat count for "part #2" reaches the eighth beat (=Nb1), two images a1 and b1 become available for display. In this case, the display area of the display device 22 is partitioned into two areas. One area displays image a1 and the other area displays image b1 simultaneously (see (2) in FIG. 11). When the current beat counts for "part #3" and "part #4" reach the twelfth beat (=Nc1), image c1 also becomes available for display in addition to images a1 and b1. In this case, the display area of the display device 22 is partitioned into three areas. The left area displays image a1; the center area displays image b1; and the right area displays image c1 (see (3) in FIG. 11). When the current beat count for "part #1" reaches the second preset beat count Na2 set to "15", the display area maintains the unchanged number of partitions, i.e., the unchanged number of images to be displayed. Image a1 displayed so far changes to image a2 (see (4) in FIG. 11).

According to the embodiment as mentioned above, the display device displays images at the timings corresponding to user's actions. The user can easily enjoy performance actions compared to a case where images are displayed at predetermined timings, namely, independently of user's actions. By visually checking display images, the user can intuitively confirm that the performance reflects his or her action.

When it becomes necessary to display a plurality of images on the display device 22 in accordance with the song progression, these images are simultaneously displayed on partitions of the display area of the display device 22. Accordingly, a plurality of users can enjoy performance using one display device 22, saving performance system costs.

<B: Second Embodiment>

The following describes the second embodiment of the present invention. The present embodiment and the first embodiment have something in common concerning the configuration of the performance system and the operation device 30 and the performance processing apparatus 10 constituting the performance system. The following mainly describes differences of the performance system according to the second embodiment from the first embodiment. A description of the common points is omitted appropriately.

The first embodiment controls song tempos based on the detection information and displays images on the display device 22 in accordance with the song progression. According to the second embodiment, by contrast, partitions in the display area of the display device 22 are allocated to the respective operation devices 30, and each partitioned area displays an image (see FIG. 14). A display mode for each image varies with the detection information transmitted from the operation device 30 corresponding to that display area.

The configuration of the performance file used for the embodiment is the same as that shown in FIGS. 5 through 7 except the image data chunk. FIG. 12 shows a configuration of the image data chunk contained in the performance file according to the embodiment. As shown in FIG. 12, the image data chunk contains a plurality of image data representing different images. Each image data is associated with the information about the contents of user's actions (hereafter referred to as "action information"). When the CPU 101 detects the contents of the user's action in accordance with the detection information, an image is displayed on the display device 22 based on the image data associated with the action information indicating the action contents. For each operation device 30, the display device 22 displays an image corresponding to an action of the user who owns that operation device 30. According to the embodiment, the action information includes a time interval between two speed minimums corresponding to movements of the operation device 30; and a movement speed of the operation device 30.

Figure 13:
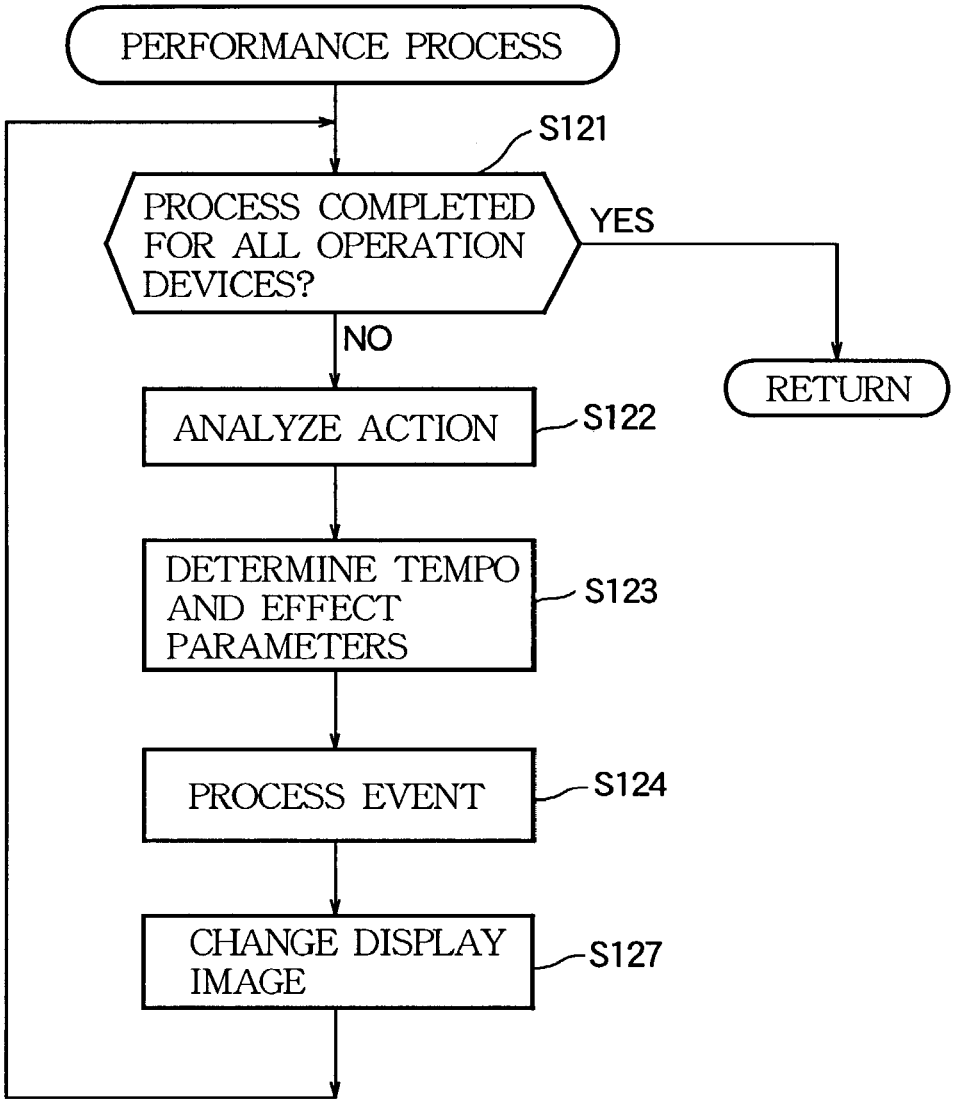
FIG. 13 is a flowchart showing contents of the performance process carried out by the performance processing apparatus.

The following describes operations according to the embodiment. When the user operates the input device 104, the CPU 101 executes the main routine shown in FIG. 9. FIG. 13 is a flowchart showing the contents of the performance process executed at step S12 of the main routine. During the performance process according to the embodiment as shown in FIG. 13, the CPU 101 changes display images (step S127) instead of steps S125 and S126 of the performance process in FIG. 10.

At step S127, the CPU 101 retrieves the action information corresponding to the action analyzed at step S122 from the image data chunk in the performance file to be processed. Further, the CPU 101 reads image data associated with the retrieved action information and outputs the image data together with the identification information of the target operation device 30 to the display control circuit 108. Like the first embodiment, the CPU 101 executes the process from steps S122 to S127 for all the operation devices 30, and then returns control to step S13 in FIG. 9.

Figure 14:
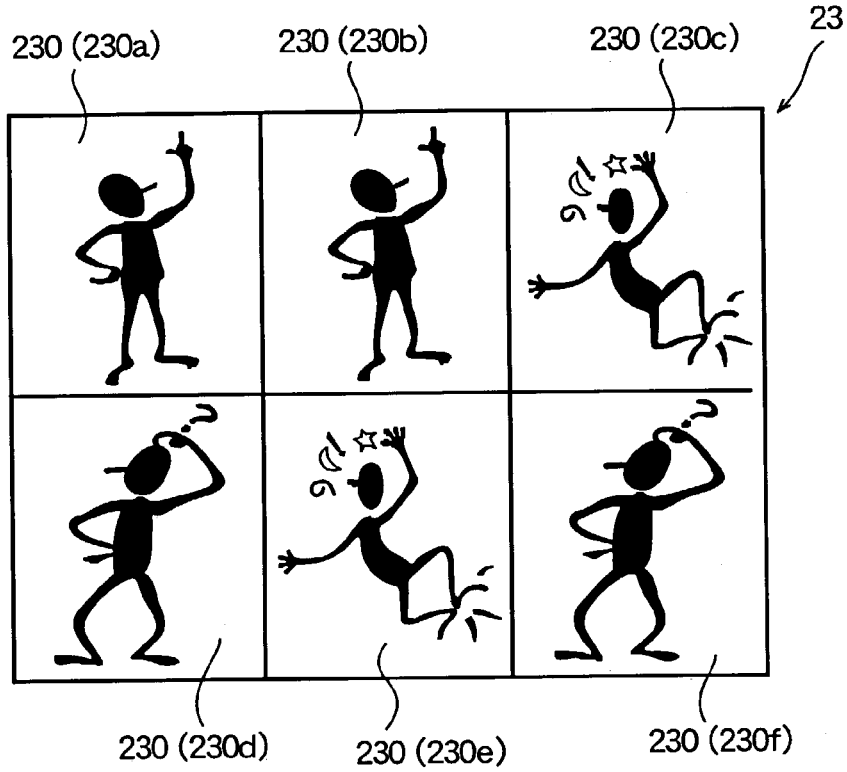
FIG. 14 shows an example of display contents on a display device.

The display area of the display device 22 is partitioned into a plurality of areas (hereafter referred to as "partitioned display areas"). Based on the image data and the identification information received from the CPU 101, the display control circuit 108 displays an image in the partitioned display area allocated to the target operation device 30. This process is executed for all the operation devices 30. As a result, each partitioned display area of the display device 22 displays an image associated with the action of the user who owns the operation device 30 corresponding to that area. FIG. 14 shows specific display contents on the display device 22 according to the embodiment. In FIG. 14, it is assumed that six operation devices 30 are used. Accordingly, a display area 23 of the display device 22 is divided into six partitioned display areas (230*a*, 230*b*, 230*c*, 230*d*, 230*e*, and 230*f*) which display images associated with actions of the users who own the respective operation devices 30. The following description represents "user a" as a user of the operation device 30 corresponding to a partitioned display area 230*a*, "user b" as a user of the operation device 30 corresponding to a partitioned display area 230*b*, and so on.

Now, let us consider that the users a and b take similar actions. In this case, as shown in FIG. 14, the partitioned display areas 230*a*and 230*b* display the same image associated with the user's action. The same applies to a combination of the partitioned display areas 230*c* and 230*e* and a combination of the partitioned display areas 230*d* and 230*f*.

Further, each partitioned display area 230 displays an image whose content represents each user's action. For example, let us assume that users a and b act promptly (smoothly); users c and e act slowly (clumsily); and users d and f act at a medium speed. At this time, the partitioned display areas 230*a* and 230*b* each display a human silhouette facing upward. The partitioned display areas 230*d* and 230*f* each display a bewildering human silhouette. The partitioned display areas 230*c* and 230*e* each display a stumbling human silhouette.

Since the embodiment changes display images according to users' actions, each user can easily enjoy performance actions using the operation device 30. It is possible to provide interesting and versatile display images reflecting users' actions. By visually checking display images, the user can intuitively confirm that the performance reflects his or her action.

Figure 15:
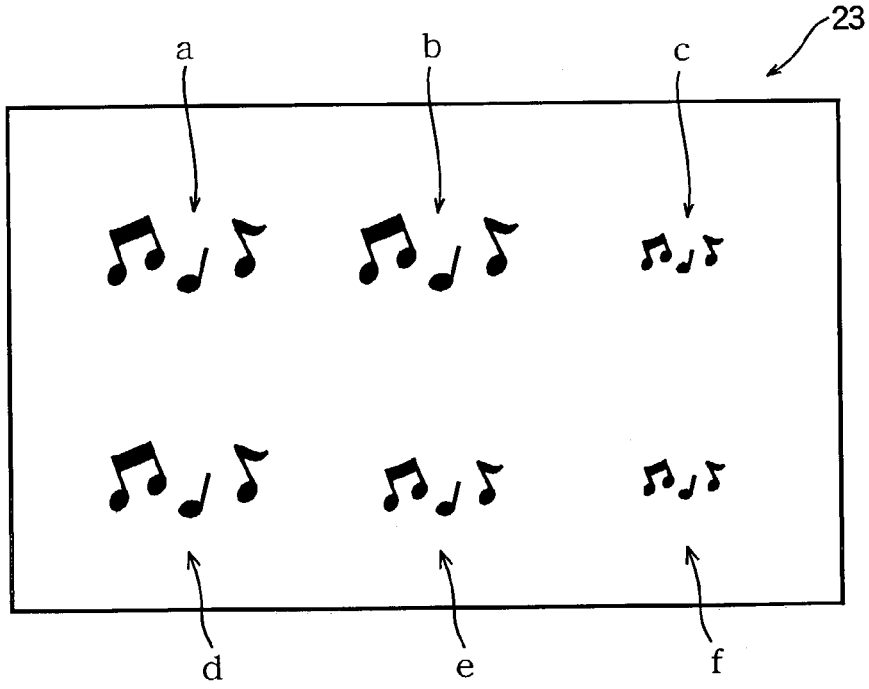
FIG. 15 shows another example of display contents on the display device.

While there has been described the configuration of changing the display image itself according to the user's action, it may be preferable to change various parameters concerning the display in accordance with users' actions without changing the display image contents. For example, it is possible to vary the brightness of images displayed in the partitioned display area 230 according to users' actions. The parameters concerning the display may include not only the image brightness, but also the coloring, resolution, image size, and the like. FIG. 15 shows an example of changing the sizes of display images on the display device 22. The example in FIG. 15 assumes that users having the operation devices 30 associated with images c, e, and f act more slowly (clumsily) than the other users. Consequently, images c, e, and f are displayed as being smaller than the other images a, b, and d.

Instead of or in addition to the adjustment of display parameters, it may be preferable to select whether or not to mosaic images or to display them in monochrome or color in accordance with users' actions. In short, the embodiment just needs to provide the configuration that can vary display rendering modes of images in accordance with the detection information representing the user's action.

<C: Third Embodiment>

The following describes the communication system according to the third embodiment of the present invention. The communication system is used to provide the performance file to the performance processing apparatus according to the present invention. The following description exemplifies the system that provides the performance file according to the first embodiment.

Figure 16:
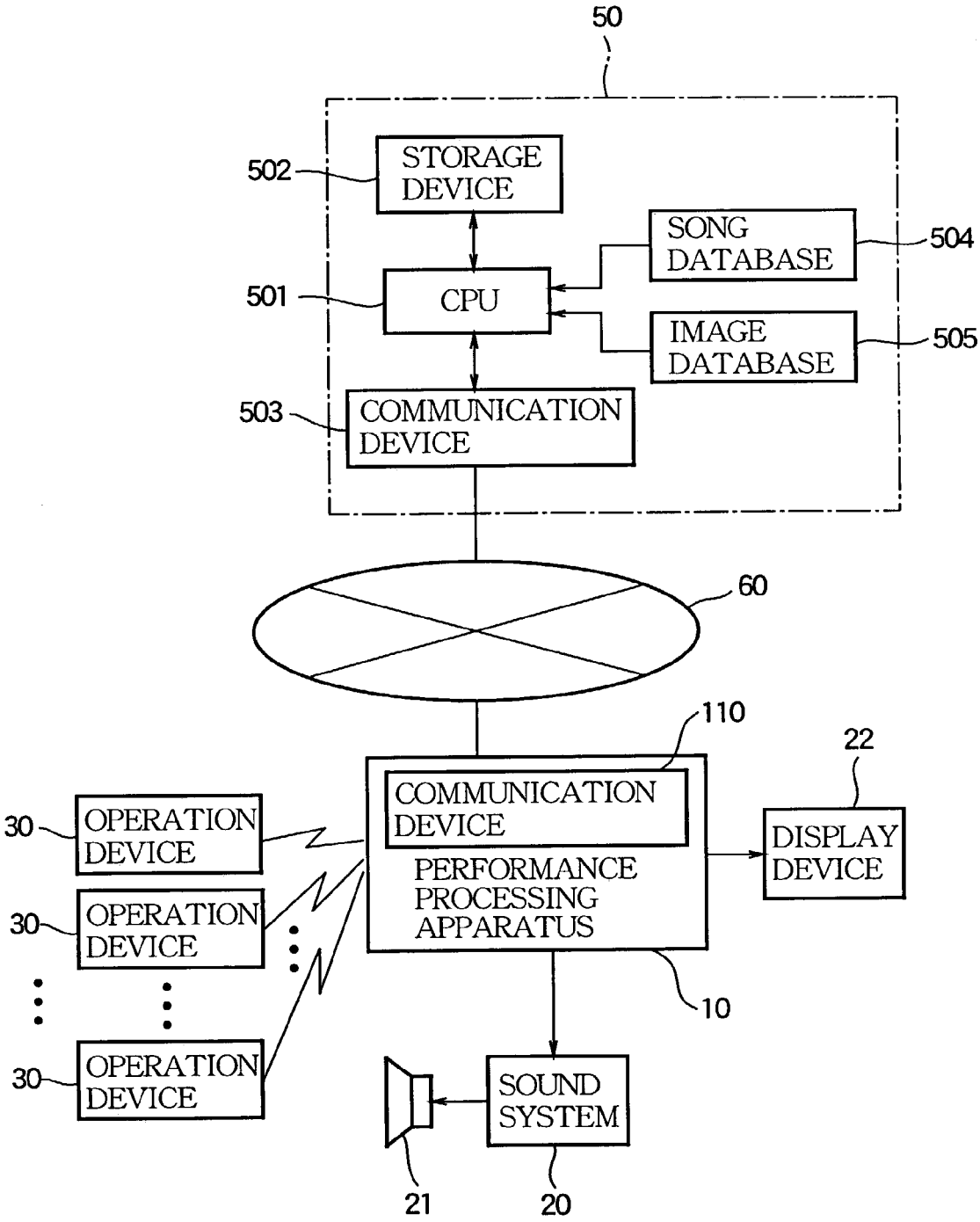
FIG. 16 is a block diagram showing a configuration of a communication system according to the third embodiment of the present invention.

FIG. 16 is a block diagram showing a configuration of the communication system according to the embodiment. As shown in FIG. 16, the system comprises a communication network 60 including the Internet and public switched telephone networks, a file creating apparatus 50 connected to the communication network 60, and the performance processing apparatus 10 according to the present invention. For simplification of the drawing, FIG. 16 shows one file creating apparatus 50 and one performance processing apparatus 10. Actually, more file creating apparatuses 50 and performance processing apparatuses 10 are connected to the communication network 60.

The performance processing apparatus 10 has the same configuration as that for the above-mentioned embodiments with the following exception. That is to say, the performance processing apparatus 10 according to the third embodiment has a communication device 110 connected to the bus 120 as well as the components shown in FIG. 4. The communication device. 110 is used for communication with the file creating apparatus 50 via the communication network 60.

The file creating apparatus 50 creates a performance file shown in FIGS. 5 through 8 and provides it to the performance processing apparatus 10. The file creating apparatus 50 comprises a CPU 501, a storage device 502, a communication device 503, a song database 504, and an image database 505. The communication device 503 is used for communication with the performance processing apparatus 10 via the communication network 60. The song database 504 stores song data for many songs. Each song data has the same data structure as the song data chunk for the performance file in FIG. 6. The image database 505 stores image data for many images.

The CPU 501 executes a file generation program stored in the storage device 502 to create a performance file containing song data stored in the song database 504 and image data stored in the image database 505. The storage device 502 not only stores the program executed by the CPU 501, but also temporarily stores the performance file created by execution of this program.

Figure 17:
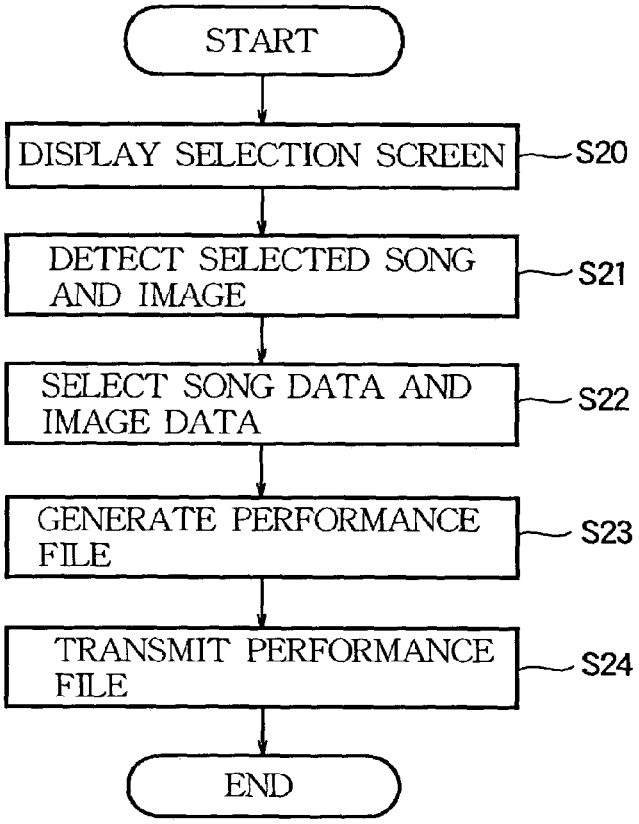
FIG. 17 is a flowchart showing operations of the file creating apparatus.

The following describes operations of the embodiment. When a user operates the input device 104 as specified, the performance processing apparatus 10 is connected to the file creating apparatus 50 via the communication network 60. When detecting this connection via the communication device 503, the CPU 501 of the file creating apparatus 50 starts executing the file generation program stored in the storage device 502. FIG. 17 is a flowchart showing the contents of this program.

Figure 18:
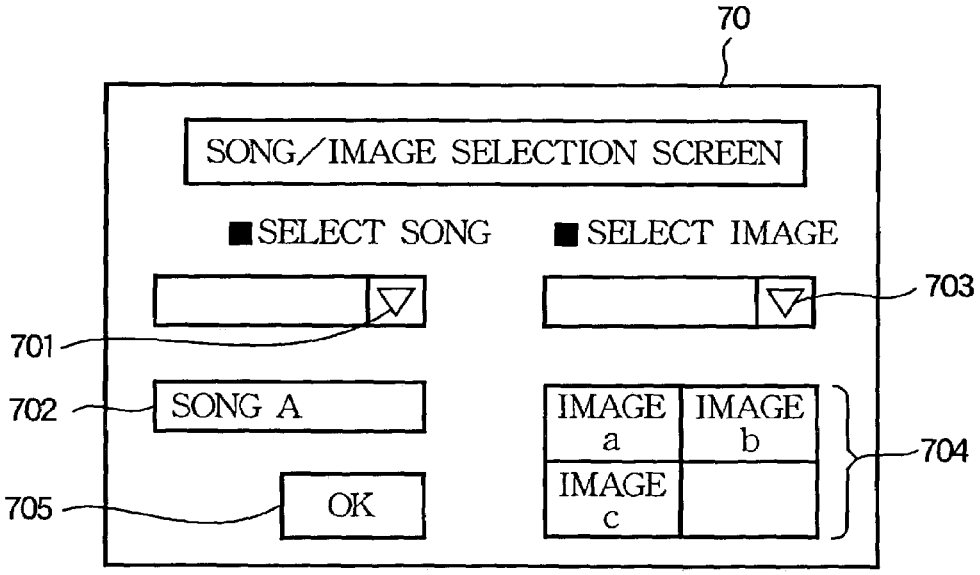
FIG. 18 shows contents of a song/image selection screen.

As shown in FIG. 17, the CPU 501 first uses the display device 22 connected to the performance processing apparatus 10 to display a song/image selection screen 70 as shown in FIG. 18 (step S20). This screen 70 allows the user of the performance processing apparatus 10 to select song data and image data contained in the performance file. Specifically, when the user operates the input device 104, selecting a song selection button 701 displays names of a plurality of songs stored as song data in the song database 504. In this state, selecting any song displays the name of this song in a display field 702. An image can be selected in the same manner. That is to say, selecting an image selection button 703 displays names of a plurality of images stored as image data in the image database 505. In this state, selecting any image displays the name of this selected image in a display field 704. The user can select a plurality of images to be included in the performance file. FIG. 18 shows an example of selecting "song A", "image a", "image b", and "image c". Upon completion of selecting the song and the image, the user selects an "OK" button 705 in the song/image selection screen. As a result, the CPU 501 of the file creating apparatus 50 detects the selected song and image (step S21).

The CPU 501 reads the user-selected song data from the song database 504 and the user-selected image data from the image database 505 (step S22). The CPU 501 then creates a performance file containing the selected song data and image data (step S23). The following describes a procedure of generating the performance file.

The CPU 501 first generates the part specification chunk as shown in FIG. 7. More specifically, the CPU 501 generates the part specification chunk in the form, of a table that keeps correspondence between the identification information about a specified number of operation devices 30 and the number of a part constituting the song. When the number of parts constituting the song exceeds the number of operation devices 30, the parts are redundantly allocated to one or more operation devices 30.

The CPU 501 then generates an image data chunk containing one or more image data selected by the user. At this time, the entire time length for the user-selected song is equally divided by the number of selected images to find the number of beats that corresponds to each of the equally divided time points. The number of beats here is defined as a preset beat count. The image data chunk comprises image data associated with each preset beat count.

Further, the CPU 501 generates a header chunk that includes song data (song data chunk), the total amount of data for the part specification chunk and the image data chunk, and data representing the length of the unit time specified for the song. Finally, the CPU 501 creates the performance file comprising the header chunk, the song data chunk, the part specification chunk, and the image data chunk generated in the above-mentioned procedure, and stores that performance file in the storage device 502.

Thereafter, the CPU 501 transmits the performance file stored in the storage device 502 to the performance processing apparatus 10 (step S24). This performance file is received by the CPU 101 of the performance processing apparatus 10, and then is stored in the external storage device 103.

As mentioned above, the embodiment creates the performance file that contains song data and image data selected by the user. The user can create a performance file without needing to have special knowledge about the file generation and can enjoy the song performance by displaying images according to his or her preference.

While there has been described the generation of the performance file according to the first embodiment, it may be preferable to create the performance file according to the second embodiment. In this case, the image data chunk contains the action information instead of the preset beat count. As described in the second embodiment, the action information specifies rendering modes (including brightness, coloring, resolution, image size, and image type) of a display image on the display device 22 in accordance with users' actions.

<D: Modifications>

While there has been described the preferred embodiments of the present invention; they are mere examples. The embodiments may be modified variously without departing from the spirit and scope of the invention. For example, the following provides available modifications.

<D-1: Modification 1>

While the above-mentioned embodiments use a two-dimensional speed sensor as the sensor 303 to detect movement speeds of the operation device 30, the type of the sensor 303 and the detection content are not limited thereto. For example, it is possible to use a sensor that detects unidirectional speeds and accelerations, a two-dimensional acceleration sensor, a three-dimensional speed sensor, and a three-dimensional acceleration sensor as the sensor 303. While the above-mentioned embodiments control a musical sound based on the time interval between speed minimums and speeds, the physical amounts used for musical sound control are not limited thereto. When a speed sensor is used as the sensor 303, for example, it may be preferable to integrate a detected speed to calculate displacements of the operation device 30 and control the musical sound in accordance with a calculation result.

While the above-mentioned embodiments control the reverb time in accordance with users' actions, the content of the effect to be controlled is not limited thereto. Furthermore, the present invention is not limited to the content or degree of the effect to be controlled in accordance with users' actions. For example, it may be preferable to control the volume, timbre, pitch, and the like of a musical sound in accordance with users' actions. That is to say, the present invention places no limitations on methods of controlling parameters concerning musical sounds in accordance with users' actions or on objects to be controlled.

<D-2: Modification 2>

While the above-mentioned embodiments and modification use the operation device 30 that can be held by a user's hand, the form of the operation device 30 is not limited thereto. For example, the operation device 30 can be provided as the sensor 303 attached to the heel of a shoe put on a user's foot so as to control musical sounds in accordance with the detection information obtained from tap-dancing.

While the above-mentioned embodiments detect user's actions, it may be preferable to detect user's physical states instead of or in addition to user's actions. For example, a pulse (pulse wave) detector is provided to the operation device 30 that can be attached to a user's body so as to control musical sounds based on the detection information representing a detection result of a heart rate. The user's physical states that can be detected by the sensor include, for example, body temperatures, resistance between skins, brain waves, breath, eye movements, and the like.

<D-3: Modification 3>

While the first embodiment displays an image at the timing corresponding to the number of beats from the beginning of the song performance, the information specifying the image display timing is not limited to the number of beats. For example, it may be preferable to display an image at the timing when a measure in the song changes to another. In this manner, "display time point specification data" according to the present invention just needs to be data that specifies any time point in a song to be performed independently of the performance speed. The data is not limited to the number of beats or measures from the beginning of the performance.

The display time point specification data is not always necessary for the present invention. For example, it may be preferable to equally divide a song performance period by the number of images prepared for the operation device and assign the image display timing to each of the corresponding time points. This configuration makes it possible to specify image display timings without the display time point specification data.

While the above-mentioned embodiments control tempos for performing songs in accordance with the detection information, it may be preferable to control the other musical elements such as rhythms and meters that specify the progression degree in accordance with the detection information. That is to say, the present invention may adjust the progression degree of a sound output specified by the tempo information or the beat information based on the detection information. The "tempo information" here refers to information that uses numeric values to specify a tempo for sound output. The "beat information" specifies a meter of the song. For example, this information may specify a time length equivalent to one beat, a temporal balance between two chronologically adjacent beats, or a song rhythm. The present invention is not limited to tempos or meters to be controlled in accordance with the detection information. In short, the present invention just needs to provide a configuration that controls the progression degree of sound output from the sound device in accordance with the detection information.

<D-4: Modification 4>

While the first embodiment displays images at the timing corresponding to each user's action or physical state, there may be added a configuration that controls the rendering modes of displayed images in accordance with the song's progression degree. Like the second embodiment, for example, it may be preferable to control the brightness, coloring, resolution, image size, or contents of display images in accordance with the song's progression degree. For example, progressing the song fast may make the image bigger. On the contrary, progressing the song slow may make the image smaller.

<D-5: Modification 5>

While the above-mentioned embodiments and modifications use the single display device 22 to display images corresponding to each user's action or physical state, it may be preferable to provide a plurality of display devices 22 for respective users and use each of the display devices 22 to display images corresponding to actions or physical states of one user. Alternatively, it may be preferable to divide a plurality of users into a plurality of groups and provide the display device 22 that displays images corresponding to actions of one or more users belonging to a given group.

The above-mentioned embodiments use the single speaker 21 to output all parts of musical sounds constituting a song. It may be also preferable to provide the speaker 21 for one operation device 30 allocated with one or more parts, i.e., for each user, and use each speaker 21 to output musical sounds of parts allocated to the user corresponding to that speaker 21.

<D-6: Modification 6>

While the first and second embodiments use the same storage device (external storage device 103) to store song data and image data, it may be preferable to use different storage devices to store song data and image data. That is to say, it is not always necessary for the present invention to configure a single file comprising song data and image data.

<D-7: Modification 7>

According to the third embodiment, the song database 504 of the file creating apparatus 50 stores song data in advance. After a user selects song data therefrom, the selected song data is included in the performance file. In addition, it may be preferable that the user prepares or creates song data; the performance processing apparatus 10 transmits this song data to the file creating apparatus 50; and the file creating apparatus 50 creates a performance file, containing that song data. The same applies to image data. It may be preferable that the user prepares or creates image data; the performance processing apparatus 10 transmits this image data to the file creating apparatus 50; and the file creating apparatus 50 creates a performance file containing that image data. In this case, image data transmitted from the performance processing apparatus 10 to the file creating apparatus 50 may represent images captured by the user using a digital camera or a scanner.

According to the third embodiment, the file creating apparatus 50 creates a performance file that is then transmitted to the performance processing apparatus 10. Further, the performance processing apparatus 10 may create performance files. That is to say, it may be preferable that the external storage device 103 in FIG. 4 stores a plurality of song data and image data, and the file generation program; and the CPU 101 executes the file generation program to create a performance file.

While the third embodiment transmits the performance file to the performance processing apparatus 10 via the network 60, the method of providing the performance file is not limited thereto. For example, the file creating apparatus 50 may be installed in a specified shop (e.g., a musical instrument store or a music studio) and create performance files according to users' requests. The performance files may be stored in portable storage media such as flexible disks or CD-ROM disks and be provided to users.

<D-8: Modification 8>

The present invention can be also specified as a program (performance processing program) that allows a computer to function as the performance processing apparatus. The program may be provided to the computer from a specified server via networks such as the Internet. Alternatively, the program may be provided as stored in recording media and be installed on the computer. Available recording media include not only optical disks such as CD-ROM (Compact Disk-Read Only Memory), but also portable magnetic disks.

Further, the present invention can be specified as a program (file generation program described in the third embodiment) that allows a computer to function as the file creating apparatus. That is to say, the program to create the performance file according to the first embodiment allows the computer to implement the function of generating a file, containing sound data, image data, and display time point specification data that specifies a time point to display an image based on the image data during a song corresponding to the song data. On the other hand, the program to create the performance file according to the second embodiment implements the function of generating a file containing sound data, one or more image data, and action information that specifies rendering modes of display images based on any image data in accordance with user's action contents. The program may be provided to the computer via networks such as the Internet. Alternatively, the program may be provided as stored in recording media such as CD-ROM or portable magnetic disks and be installed on the computer.

As mentioned above, the present invention allows a user to easily enjoy the performance while an image is displayed in accordance with user's performance actions.

The entire content of Priority Document No. 2002-191105 is incorporated herein by reference.

What is claimed is:

1. A performance processing apparatus operable by an operation device and equipped with a sound device and a display device, comprising:

a storing section that stores song data representative of a music sound constituting a music song, and stores image data representative of an image;

an acquiring section that acquires detection information from the operation device, which is used by a user and which has a detector for detecting a chronological action or state of the user and outputting the detection information representative of the detected chronological action or state;

a sound control section that generates the music sound through the sound device according to the song data, and that controls a progression degree of the generation of the music sound according to the acquired detection information; and a display control section that displays the image by the display device according to the image data in correspondence with the progression degree of the generating of the music sound.

2. The performance processing apparatus according to claim 1, wherein the sound control section controls the progression degree of the music sound in terms of a tempo or a beat of the music song.

3. The performance processing apparatus according to claim 1, wherein the storing section stores the image data representative of a plurality of images associated to one music song, and the display control section sequentially displays the plurality of the images in synchronization with the progression degree of the music sound.

4. The performance processing apparatus according to claim 1, wherein the storing section stores timing specification data which specifies a timing of displaying the image in association with the music song, so that the display control section displays the image in correspondence to the progression degree of the music sound based on the timing specification data.

5. The performance processing apparatus according to claim 4, wherein the storing section stores the song data, the image data and the timing specification data in the form of a composite file.

6. The performance processing apparatus according to claim 1, wherein the storing section stores the song data representative of music sounds constituting a plurality of parts of the music song, the acquiring section acquires a plurality of detection information from a plurality of operation devices, each of which is used by each user in correspondence with at least one part of the music song, the sound control section controls the progression degrees of the music sounds of the respective parts according to the plurality of the detection information acquired from the plurality of the operation devices corresponding to the respective parts, and the display control section displays a plurality of images according to the image data in correspondence with the plurality of the parts, and controls the displaying of the images in synchronization to the progression degree of the corresponding parts.

7. The performance processing apparatus according to claim 6, wherein the storing section stores the image data representative of the plurality of the images in correspondence with the plurality of the parts of the music song, and the display control section divides a screen frame of the display device into a plurality of sub frames and displays the respective images in the respective sub frames in synchronization to the progression degree of the respective parts.

8. The performance processing apparatus according to claim 6, wherein the storing section stores the image data representative of the plurality of the images in correspondence with the plurality of the parts of the music song, and the display control section displays the respective images on respective ones of separate display devices in synchronization to the progression degree of the respective parts.

9. The performance processing apparatus according to claim 1, wherein the display control section controls a rendering mode of the image displayed on the display device in accordance with a progression state of the generating of the music sound.

10. The performance processing apparatus according to claim 9, wherein the display control section controls the rendering mode of the displayed image in terms of a brightness, a color tone, an effect, a resolution or a size of the image.

11. The performance processing apparatus according the claim 1, wherein the sound control section controls the music sound generated by the sound device according to the detection information in terms of a volume, a tone, an effect and a pitch of the music sound.

12. A performance processing apparatus operable by an operation device and equipped with a sound device and a display device, comprising:

a storing section that stores song data representative of a music sound constituting a music song, and stores image data representative of an image;

an acquiring section that acquires detection information from the operation device, which is used by a user and which has a detector for detecting a chronological action or state of the user and outputting the detection information representative of the detected chronological action or state;

a sound control section that generates the music sound through the sound device according to the song data and controls the generating of the music sound according to the acquired detection information; and a display control section that displays the image by the display device according to the image data and controls a rendering mode of the image displayed on the display device according to the acquired detection information.

13. The performance processing apparatus according to claim 12, wherein the storing section stores the song data representative of the music sounds constituting a plurality of parts of the music song, the acquiring section acquires a plurality of detection information from a plurality of operation devices, each of which is used by each user in correspondence with at least one part of the music song, the sound control section controls the progression degrees of the music sounds of the respective parts according to the plurality of the detection information acquired from the plurality of the operation devices corresponding to the respective parts, and the display control section displays a plurality of images according to the image data in correspondence with the plurality of the parts, and controls the displaying of the images in synchronization to the progression degree of the corresponding parts.

14. The performance processing apparatus according to claim 12, wherein the display control section controls the rendering mode of the displayed image in terms of a brightness, a color tone, an effect, a resolution or a size of the image.

15. The performance processing apparatus according the claim 12, wherein the sound control section controls the music sound generated by the sound device according to the detection information in terms of a volume, a tone, an effect and a pitch of the music sound.

16. A computer program for use in a performance processing apparatus being operable by an operation device and being equipped with a sound device, a display device, and a storage device which stores song data representative of a music sound constituting a music song and image data representative of an image, the computer program being executable by the performance processing apparatus for performing a process comprising the steps of:

acquiring detection information from the operation device, which is used by a user and which has a detector for detecting a chronological action or state of the user and outputting the detection information representative of the detected chronological action or state;

generating the music sound through the sound device according to the song data;

controlling a progression degree of the generation of the music sound according to the acquired detection information; and displaying the image by the display device according to the image data in correspondence with the progression degree of the generating of the music sound.

17. A computer program for use in a performance processing apparatus being operable by an operation device and being equipped with a sound device, a display device, and a storage device which stores song data representative of a music sound constituting a music song and image data representative of an image, the computer program being executable by the performance processing apparatus for performing a process comprising the steps of:

acquiring detection information from the operation device, which is used by a user and which has a detector for detecting a chronological action or state of the user and outputting the detection information representative of the detected chronological action or state;

generating the music sound through the sound device according to the song data;

controlling the generating of the music sound according to the acquired detection information;

displaying the image by the display device according to the image data; and controlling a rendering mode of the image displayed on the display device according to the acquired detection information.

18. A file creating apparatus for creating a data file used in a performance processing apparatus which generates a music sound constituting a music song through a sound device at a progression degree corresponding to a chronological action or state of a user and which displays an image on a display device at a timing corresponding to progression of the music sound, the file creating apparatus comprising:

a storing section that stores song data representative of the music sound to be generated through the sound device;

another storing section that stores image data representative of the image to be displayed on the display device along with the generating of the music sound; and a creating section that provides timing specification data which specifies a timing to display the image in correspondence to the progression of the music sound, and that integrates the song data, the image data and the timing specification data into the data file for use in the performance processing apparatus.

19. A file creating apparatus for creating a data file used in a performance processing apparatus which controls a music sound constituting a music song generated by a sound device and which displays an image on a display device along with a progression of the music song in response to a chronological action or state of a user, the file creating apparatus comprising:

a storing section that stores song data representative of the music sound to be generated through the sound device;

another storing section that stores image data representative of the image to be displayed on the display device along with the progression of the music song; and a creating section that provides rendering specification data which specifies a rendering mode of the image in accordance with the chronological action or state of the user, and that integrates the song data, the image data and the rendering specification data into the data file for use in the performance processing apparatus.

20. A method carried out in a performance processing apparatus being operable by an operation device and being equipped with a sound device, a display device, and a storage device which stores song data representative of a music sound constituting a music song and image data representative of an image, the method comprising the steps of:

acquiring detection information from the operation device, which is used by a user and which has a detector for detecting a chronological action or state of the user and outputting the detection information representative of the detected chronological action or state;

generating the music sound through the sound device according to the song data;

controlling a progression degree of the generation of the music sound according to the acquired detection information; and displaying the image by the display device according to the image data in correspondence with the progression degree of the generating of the music sound.

21. A method carried out in a performance processing apparatus being operable by an operation device and being equipped with a sound device, a display device, and a storage device which stores song data representative of a music sound constituting a music song and image data representative of an image, the method comprising the steps of:

acquiring detection information from the operation device, which is used by a user and which has a detector for detecting a chronological action or state of the user and outputting the detection information representative of the detected chronological action or state;

generating the music sound through the sound device according to the song data;

controlling the generating of the music sound according to the acquired detection information;

displaying the image by the display device according to the image data; and controlling a rendering mode of the image displayed on the display device according to the acquired detection information.

* * * * *